US007537038B2

(12) United States Patent
Hsieh

(10) Patent No.: US 7,537,038 B2
(45) Date of Patent: May 26, 2009

(54) RELEASE CONTROL MECHANISM FOR EMERGENCY EXIT

(75) Inventor: Chung Hsien Hsieh, No. 25-1, Fen-Liao Road, Lin-Kou Hsiang, Taipei Hsien (TW)

(73) Assignees: Yuengchigear Co., Ltd., Taipei Hsien (TW); Chung Hsien Hsieh, Taipei Hsien (TW)

( * ) Notice: Subject to any disclaimer, the term of this patent is extended or adjusted under 35 U.S.C. 154(b) by 937 days.

(21) Appl. No.: 11/128,796

(22) Filed: May 12, 2005

(65) Prior Publication Data

US 2006/0254728 A1 Nov. 16, 2006

(51) Int. Cl.
*E05F 15/20* (2006.01)

(52) U.S. Cl. ..... 160/9; 49/141

(58) Field of Classification Search ..... 160/9, 160/8, 7, 6, 5, 4, 3, 2, 1, 133, 188, 189; 49/141, 49/200; 74/625
See application file for complete search history.

(56) References Cited

U.S. PATENT DOCUMENTS

| | | | | |
|---|---|---|---|---|
| 3,512,302 | A * | 5/1970 | Kapik et al. | 49/139 |
| 3,739,832 | A * | 6/1973 | Sivin | 160/133 |
| 5,698,073 | A * | 12/1997 | Vincenzi | 160/188 |
| 5,743,320 | A * | 4/1998 | McKeon | 160/310 |
| 2004/0154225 | A1 * | 8/2004 | Sanke et al. | 49/141 |

* cited by examiner

*Primary Examiner*—David Purol
(74) *Attorney, Agent, or Firm*—Bucknam and Archer

(57) ABSTRACT

A release control mechanism installed in a rolling door-controlled emergency exit, which includes a driving mechanism, a release control lever provided outside the driving mechanism for releasing a brake of the driving mechanism from a torsion spring member, and a releasing cable, which has a first end connected to said release control lever and a second end coupled to the release control mechanism. The release control mechanism uses a spring member to preserve pressure for moving the releasing cable, and a button for pressing by a person in case of an emergency to release the preserved pressure and to further pull the releasing cable to move the release control lever to open the rolling door of the emergency exit.

13 Claims, 5 Drawing Sheets

RELEASE CONTROL MECHANISM FOR EMERGENCY EXIT

BACKGROUND OF THE INVENTION

1. Field of the Invention

The present invention relates to the control of an emergency exit and more particularly, to a release control mechanism for emergency exit, which can easily be operated with less effort to open the emergency exit in case of an emergency.

2. Description of the Related Art

A conventional emergency exit uses a vertical or horizontal type rolling door to close/open the entrance. Normally, the rolling door of an emergency exit is closed, working as a security door. The rolling door of an emergency exit can be opened through an electric operation mode as well as by a manual operation mode. The rolling door of an emergency exit must be designed to be easily opened in case of an emergency, for example, a fire. According to conventional designs, a torsion spring is provided and coupled to the rolling shaft of the rolling door for automatically rolling up the door panel elements of the rolling door. When a person operated a release control lever to release the torsion spring, the torsion spring immediately bias the rolling shaft of the rolling door, causing the rolling shaft to roll up the door panel elements of the rolling door.

FIGS. 1*a* and 1*b* show the operation status of the manual operation mode of an emergency exit according to the prior art. As illustrated, a releasing mechanism (100) is provided having a brake adapted to brake the rolling door in the close position, a release lever (101) adapted to release the brake, a releasing cable (102), which has one end connected to the release lever (101) and the other end connected to a driving mechanism (103), which is controlled to move the releasing cable (102) by an operating rod (104). When turning the operating rod (104) upwards or downwards, the driving mechanism (103) is forced to move the releasing cable (102) and to further drive the release lever (101) to release the brake, enabling the torsion spring to bias the rolling shaft of the rolling door and to further open the emergency exit. Because the driving mechanism (103) is operated through a lever function, the arm of force must be extended so that the driving mechanism (103) can be operated with less effort. During an emergency case, a person trying to escape through the emergency case may have to spend a lot of time in finding the way to operate the driving mechanism (103). Further, it is difficult to an old or handicapped person to operate the operating rod (104).

SUMMARY OF THE INVENTION

The present invention has been accomplished under the circumstances in view. It is the main object of the present invention to provide a release control mechanism for emergency exit, which can easily be operated with less effort to open the emergency exit in case of an emergency.

To achieve this and other objects of the present invention, the release control mechanism (1) is installed in a rolling door-controlled emergency exit, which comprises a mechanism (2), a release control lever (3) provided outside the mechanism (2) for releasing a brake of the driving mechanism (2) from a torsion spring member, and a releasing cable (4), which has a first end connected to the release control lever (3) and a second end coupled to the release control mechanism (1). The release control mechanism (1) comprises a housing (10), which defines therein an accommodating chamber (11); a substrate (20) mounted inside the housing (10), the substrate (20) comprising a first vertical portion (21) disposed at one side, a second vertical portion (22) disposed at an opposite side, a third vertical portion (23) extending from the second vertical portion (22) at a bottom side, and a guide pin (231) perpendicularly extending from the third vertical portion (23) toward the first vertical portion (21); a rocker arm (30), which has a first end pivotally coupled to the second vertical portion (22) of the substrate (20), an elongated sliding slot (32) longitudinally disposed on a middle part thereof and coupled to the guide pin (231) of the substrate (20), and a pulley (34) pivotally provided at a second end thereof; a button (40), the button (40) comprising a head (45) suspending outside the housing (10), a shank (41) perpendicularly extending from the head (45) and inserted into the housing (10), a longitudinal coupling hole (42) defined in the shank (41) and coupled to the guide pin (231) to guide axial movement of the button (40) along the guide pin (231), and a stop flange (43) protruded from one end of the shank (41) remote from the head (45) and stopped against the rocker arm (30); a sliding block (50), the sliding block (50) a center through hole (51) coupled to the shank (41) of the button (40) to guide movement of the sliding block (50) along the shank (41); a crank arm (60), the crank arm (60) comprising a first end (61), a second end (62), a curved middle portion (63) pivotally connected to the substrate (20), an elongated sliding slot (611) disposed at the first end (61) and coupled to the sliding block (50) with a pin (612), a connecting portion (621) provided at the second end (62) and fastened to one end of the releasing cable (4), a notch (622) disposed at the second end (62) and adapted to engage the pulley (34) of the rocker arm (30); and a torsion spring (70) adapted to bias the crank arm (60) and to force the notch (622) of the crank arm (60) into engagement with the pulley (34) of the rocker arm (30).

By means of the traction of the button (4), the second end (62) of the crank arm (6) is moved against the spring power of the torsion spring (7) to force the notch (622) into engagement with the pulley (34) of the rocker arm (30). When pressed the button (40) in case of an emergency, the torsion spring (70) is forced to bias the crank arm (60), and therefore the releasing cable (4) is pulled to move the release control lever (3), thereby opening the emergency exit. Because the button (40) is disposed outside the housing (10), it can be seen and operated by any person approaching the emergency exit in an emergency case without hesitation, and an old, young, or disabled person can operate the button (40) to open the rolling door of the emergency exit without difficult.

DETAILED DESCRIPTION OF THE PREFERRED EMBODIMENT

A release control mechanism in accordance with the present invention is designed for use in a rolling-door controlled emergency exit, which comprises a torsion spring member that reverses the door panel elements of the rolling door of the emergency exit from the close position to the open position automatically when released as power supply failed.

Figure 1A:
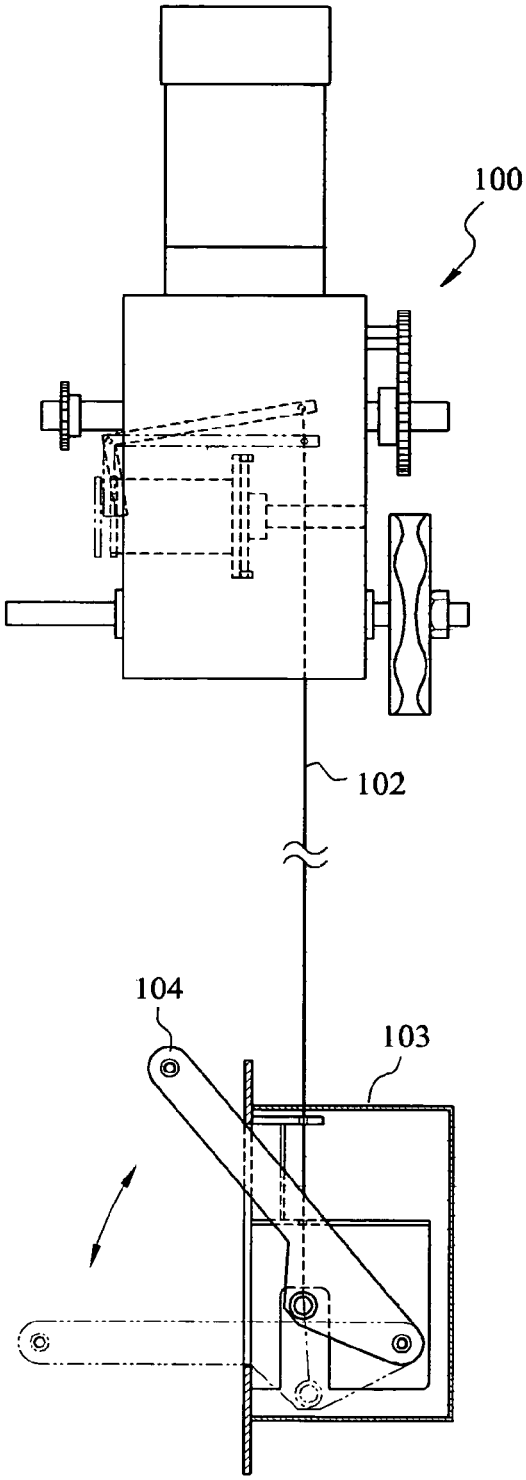
( PRIOR ART ) FIG. 1a
FIG. 1*a* is a schematic drawing showing the operation status of the pull rod mechanism of an emergency exit according to the prior art.
Figure 1B:
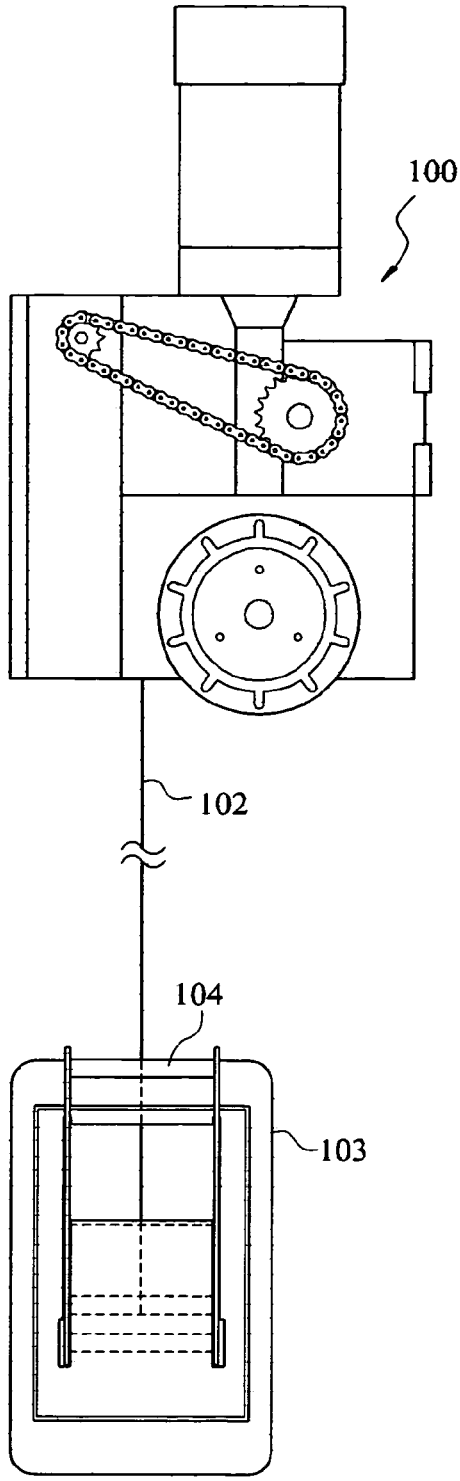
( PRIOR ART ) FIG. 1b
FIG. 1*b* is a left side view of FIG. 1*a*.
Figure 2:
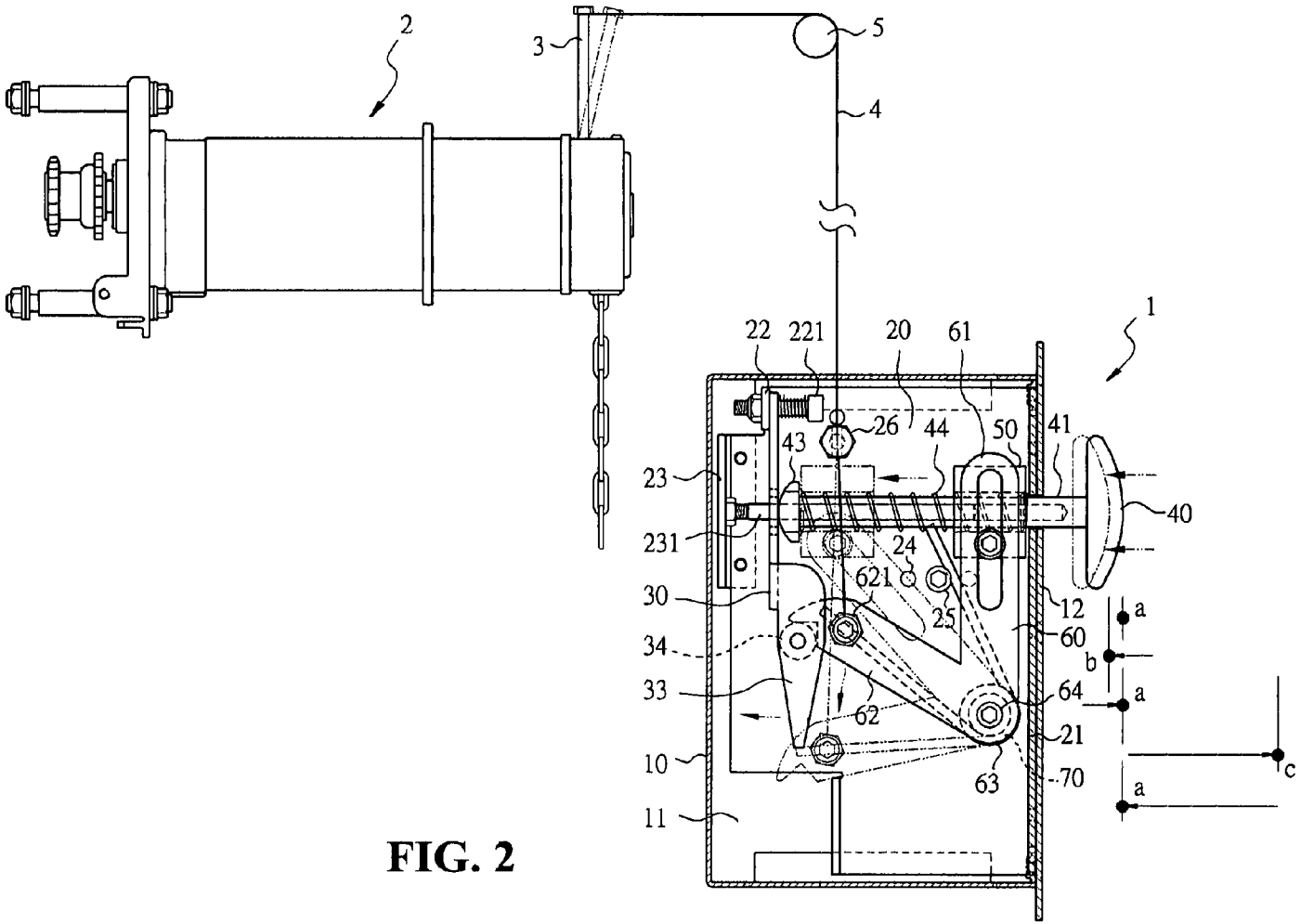
FIG. 2 is a schematic drawing showing the operation status of a release control mechanism used in an emergency exit according to the present invention.
Figure 3A:
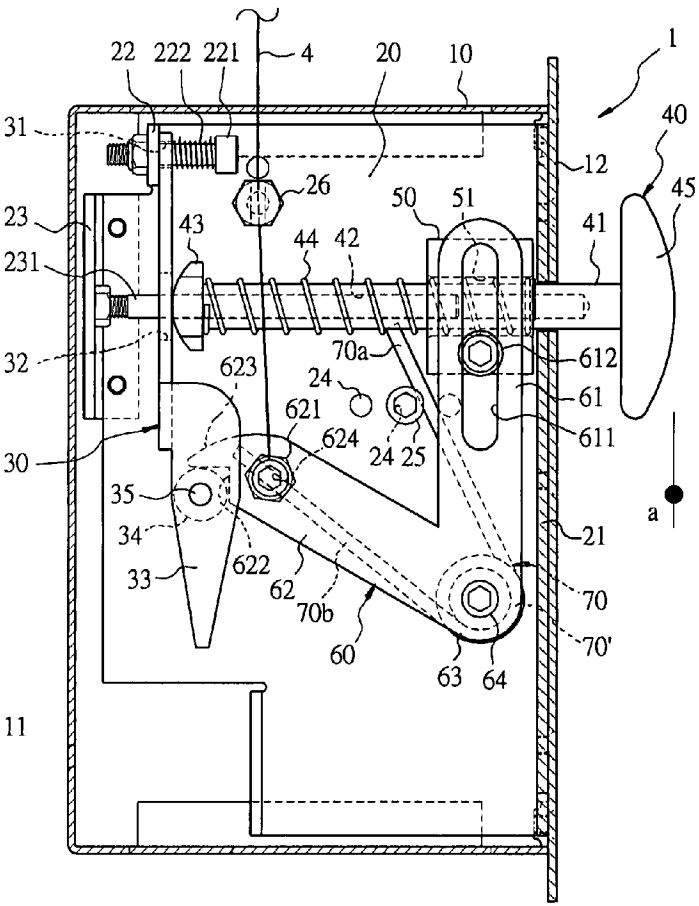
FIG. 3*a* is a sectional view taken along line 3*a*-3*a* of FIG. 3 showing the preserved status of the release control mechanism.
Figure 3:
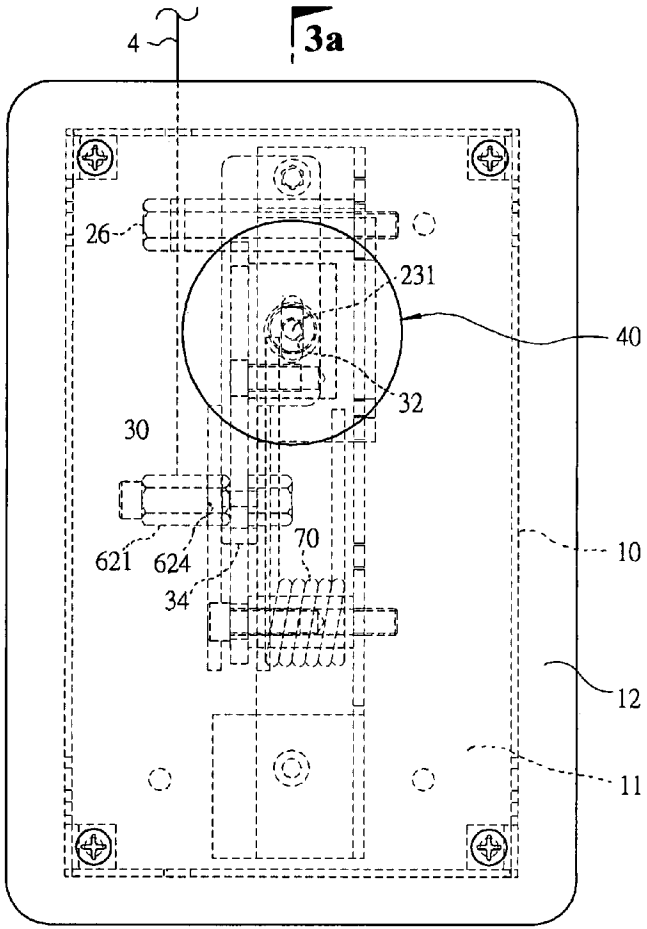
FIG. 3 is a schematic front view of the release control mechanism according to the present invention.

Referring to FIGS. 2, 3 and 3*a*, the potential energy of the torsion spring member of the rolling door of the emergency exit is stopped by a brake in a mechanism 2, keeping the rolling door of the emergency exit in the close position. A release control lever 3 is provided outside the mechanism 2 for releasing the brake of the mechanism 2 from the torsion spring member. A releasing cable 4 is provided having one end connected to the release control lever 3 and the other end extending over one or a number of pulleys 5 and coupled to the release control mechanism, referenced by 1.

The release control mechanism 1 comprises a housing 10, which defines therein an accommodating chamber 11, a face panel 12 provided at the opening of the housing 10, a substrate 20, which comprises a first vertical portion 21 fixedly fastened to the inner side of the face panel 12, a second vertical portion 22 mounted inside the accommodating chamber 11 and spaced from the first vertical portion 21 at a distance, a third vertical portion 23 extending from the second vertical portion 22 at a bottom side, and a guide pin 231 perpendicularly connected to the third vertical portion 23 and extending forward toward the first vertical portion 21, a rocker arm 30, which has a pivot hole 31 disposed at one end thereof and pivotally coupled to the second vertical portion 22 of the substrate 20 with a pivot pin 221 and a spring 222 being mounted on the pivot pin 221 and stopped against said rocker arm 30, an elongated sliding slot 32 longitudinally disposed on the middle and coupled to the guide pin 231, a mounting portion 33 at the other end, and a pulley 34 pivotally fastened to the mounting portion 33 with a pivot pin 35, a button 40, which comprises a head 45 suspending outside the housing 10, a shank 41 perpendicularly extending from the head 45 and inserted into the inside of the housing 10, a coupling hole 42 defined in the shank 41 and axially extending to the free end of the shank 41 opposite to the head 45 and coupled to the guide pin 231 to guide axial movement of the button 40 along the guide pin 231, and a stop flange 43 protruded from the free end of the shank 41 and stopped against the rocker arm 30, a sliding block 50, which comprises a center through hole 51 coupled to the shank 41 to guide movement of the sliding block 50 along the shank 41, a return spring 44, which is inserted through the center through hole 51 and extending around the shank 41 and stopped between the first vertical portion 21 of the substrate 20 and the stop flange 43 to force the stop flange 43 against the rocker arm 30, a crank arm 60, which has a first end 61, a second end 62 extending toward the mounting portion 33 of the rocker arm 30, a curved middle portion 63 pivotally connected to the substrate 20 with a pivot pin 64, an elongated sliding slot 611 disposed at the first end 61 and coupled to the sliding block 50 with a pin 612, a connecting portion 621 provided at the second end 62 and fastened to one end of the aforesaid releasing cable 4, which passes through a guide 26 at the substrate 20, a notch 622 disposed at the second end 62, and a smoothly arched guide portion 623 disposed at the second end 62 adjacent to the notch 622, and a torsion spring 70, which has a coiled middle portion 70' coupled to the pivot pin 64 at the curved middle portion 63 of the crank arm 60, a first end 70*a* stopped at a screw bolt 25 that is selectively fastened to one of a set of screw holes 24 at the substrate 20, and a second end 70*b* inserted through a through hole 624 at the connecting portion 621 of the second end 62 of the crank arm 60. The radial width of the torsion spring 70 is determined subject to the acting force of the release control lever 3 such that the traction force from the button 40 forces the second end 62 of the crank arm 60 against the torsion spring 70 to move the notch 622 into engagement with the pulley 34 of the rocker arm 30 (see FIG. 3*a*), at this time the button 40 is kept in the prime position a and the release control lever 3 is kept in the locking position.

Figure 4:
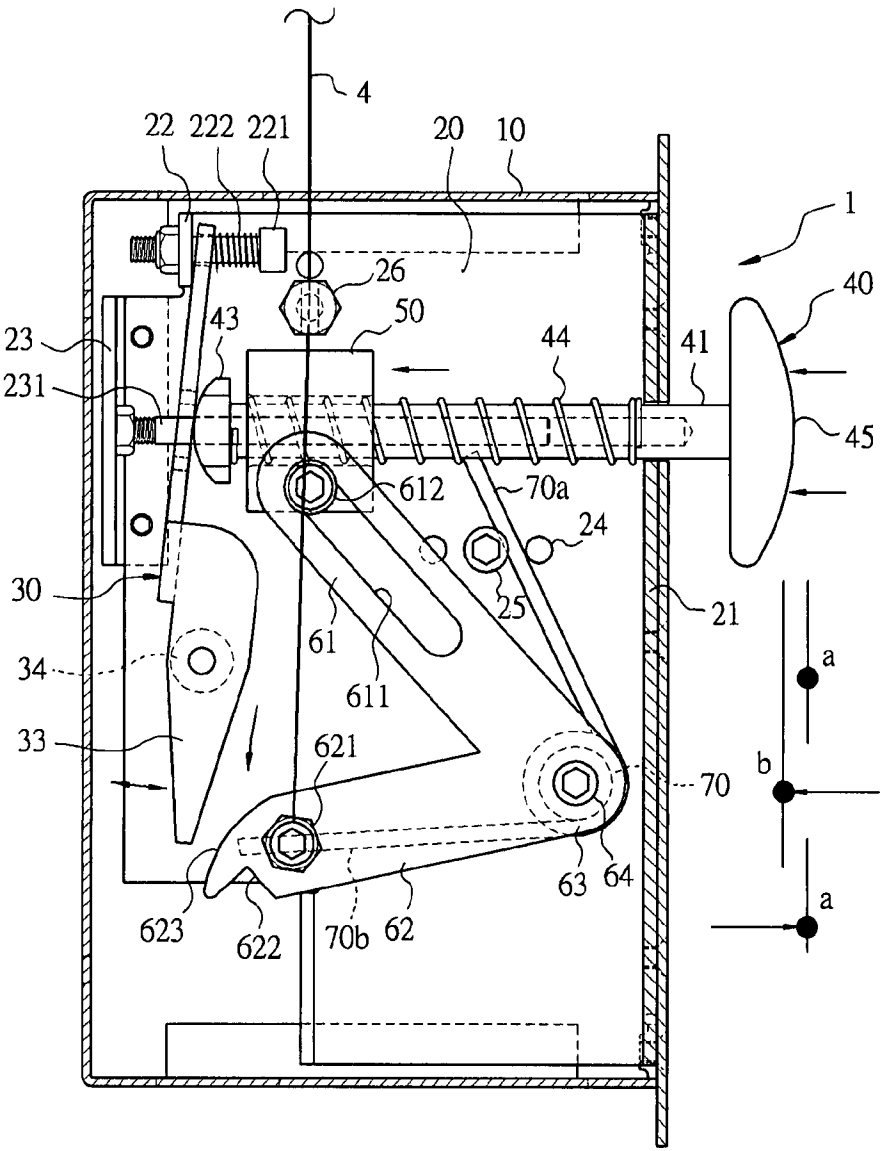
FIG. 4 is a sectional view of the present invention showing the released status of the mechanism.

In case of a fire accident, the user can press the button 40 to open the rolling door of the emergency exit. When pressed the button 40 (from the prime position a to the working position b as shown in FIG. 4, the stop flange 43 of the shank 41 pushes the rocker arm 30 backwards to disengage the pulley 34 from the notch 622 of the crank arm 60, enabling the torsion spring 70 to bias the crank arm 60 (see the direction of the arrowhead sign), and therefore the releasing cable 4 is pulled to move the release control lever 3 and to further release the brake. Upon release of the brake, the torsion spring member of the driving mechanism 2 immediately reverses the door panel elements of the rolling door of the emergency exit from the close position to the open position automatically to open the emergency exit. Because the button 40 is disposed outside the housing 10, it can be seen and operated by any person approaching the emergency exit in an emergency case without hesitation, and an old, young, or disabled person can operate the button 40 to open the rolling door of the emergency exit without difficult.

Figure 5:
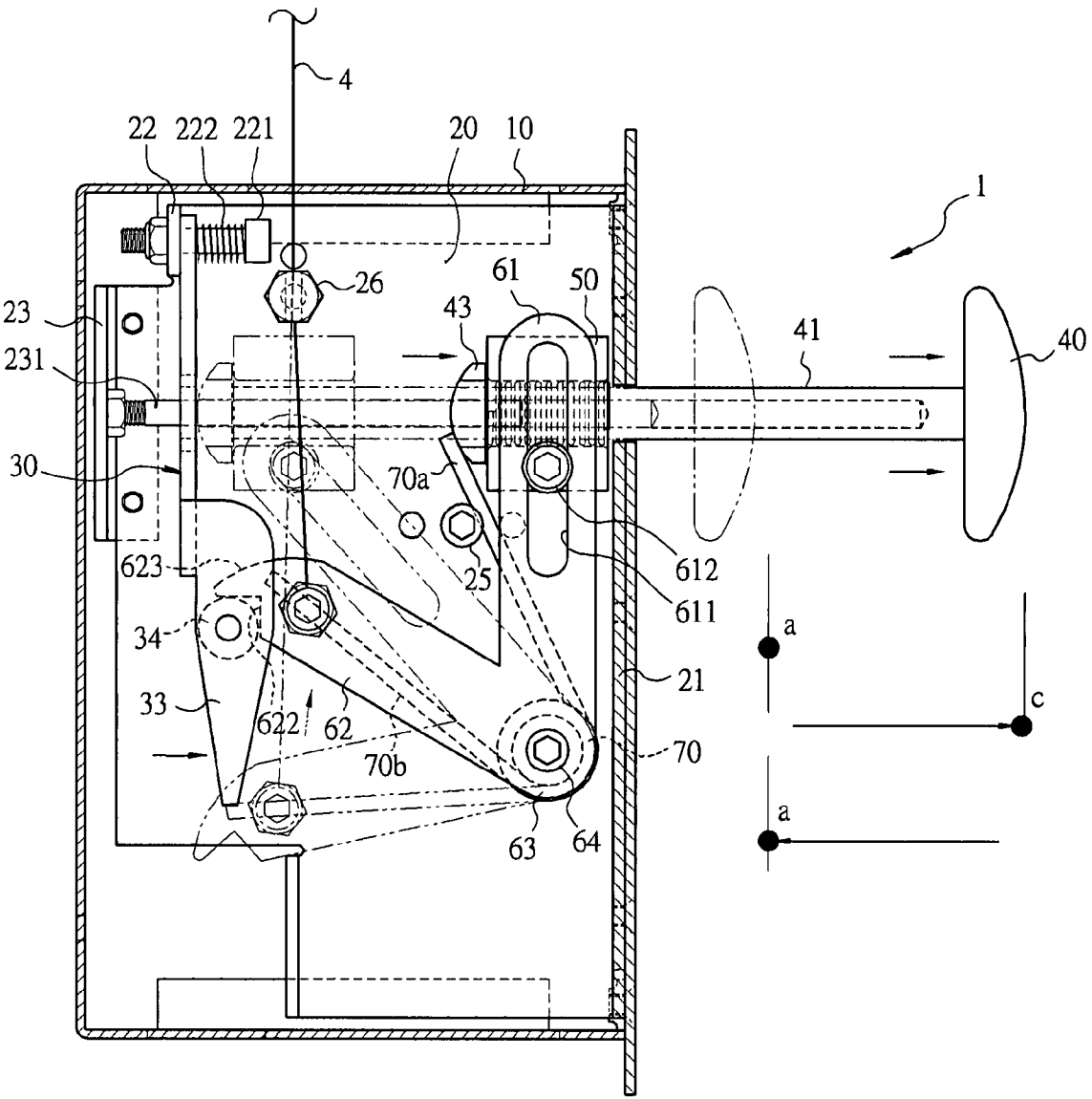
FIG. 5 is a schematic sectional view of the present invention showing the release control mechanism returned from the released status to the preserved status.

Referring to FIG. 5, returning the release control mechanism 1 from the pressure released status of the pressure preserved status should be operated by the operator. As illustrated, the rocker arm 30 returns to its former position immediately after disengagement from the notch 622 of the crank arm 60, and the first end 61 of the crank arm 60 is forced by the torsion spring 70 toward the stop flange 43, and therefore the button 40 is pulled from the prim position a to the return position c, causing the stop flange 43 to move the first end 61 toward the first vertical portion 21. At this time, the pulley 34 is moved with the rocker arm 30 along the guide portion 623 of the second end 62 into the notch 622 to stop the release control lever 3 in the locking position, and the return spring 44 imparts a pressure to the stop flange 43, thereby returning the button 40 to the prime position a.

A prototype of release control mechanism for emergency exit has been constructed with the features of FIGS. 2~5. The release control mechanism for emergency exit functions smoothly to provide all of the features discussed earlier.

Although a particular embodiment of the invention has been described in detail for purposes of illustration, various modifications and enhancements may be made without departing from the spirit and scope of the invention.

What is claimed is:

1. A release control mechanism (1) installed in a rolling door-controlled emergency exit, which comprises a mechanism (2), a release control lever (3) provided outside said mechanism (2) for releasing a brake of said mechanism (2) from a torsion spring member, and a releasing cable (4), which has a first end connected to said release control lever (3) and a second end coupled to said release control mechanism (1), said release control mechanism (1) comprising:

a housing (10), which defines therein an accommodating chamber (11);

a substrate (20) mounted inside said housing (10), said substrate (20) comprising a first vertical portion (21) disposed at one side, a second vertical portion (22) disposed at an opposite side, a third vertical portion (23)

extending from said second vertical portion (22) at a bottom side, and a guide pin (231) perpendicularly extending from said third vertical portion (23) toward said first vertical portion (21);

a rocker arm (30), which has a first end pivotally coupled to said second vertical portion (22) of said substrate (20), an elongated sliding slot (32) longitudinally disposed on a middle part thereof and coupled to the guide pin (231) of said substrate (20), and a pulley (34) pivotally provided at a second end thereof;

a button (40), said button (40) comprising a head (45) suspending outside said housing (10), a shank (41) perpendicularly extending from said head (45) and inserted into said housing (10), a longitudinal coupling hole (42) defined in said shank (41) and coupled to said guide pin (231) to guide axial movement of said button (40) along said guide pin (231), and a stop flange (43) protruded from one end of said shank (41) remote from said head (45) and stopped against said rocker arm (30);

a sliding block (50), said sliding block (50) a center through hole (51) coupled to said shank (41) of said button (40) to guide movement of said sliding block (50) along said shank (41);

a crank arm (60), said crank arm (60) comprising a first end (61), a second end (62), a curved middle portion (63) pivotally connected to said substrate (20), an elongated sliding slot (611) disposed at the first end (61) and coupled to said sliding block (50) with a pin (612), a connecting portion (621) provided at the second end (62) and fastened to one end of said releasing cable (4), a notch (622) disposed at the second end (62) and adapted to engage the pulley (34) of said rocker arm (30); and a torsion spring (70) adapted to bias said crank arm (60) and to force said notch (622) of said crank arm (60) into engagement with said pulley (34) of said rocker arm (30).

2. The release control mechanism (1) according to claim 1, wherein said housing (10) comprises a face panel (12); said first vertical portion (21) of said substrate (20) is fixedly fastened to an inner side of said face panel (12).

3. The release control mechanism (1) according to claim 1, wherein said rocker arm (30) has a pivot hole (31) disposed at the first end thereof and pivotally coupled to said second vertical portion (22) of said substrate (20) with a pivot pin (221) and a spring (222) being mounted on the pivot pin (221) and stopped against said rocker arm (30).

4. The release control mechanism (1) according to claim 1, wherein said button (40) further comprises a return spring (44), which is inserted through said sliding block (50) and extending around said shank (41) and stopped between said first vertical portion (21) of said substrate (20) and said stop flange (43) of said button (40).

5. The release control mechanism (1) according to claim 1, wherein said rocker arm (30) has the second end thereof extending vertically downwards and terminating in a mounting portion (33).

6. The release control mechanism (1) according to claim 5, wherein said pulley (34) of said rocker arm (30) is pivotally fastened to said mounting portion (33) with a pivot pin (35).

7. The release control mechanism (1) according to claim 6, wherein the second end (62) of said crank arm (60) extends toward said mounting portion (33) of said rocker arm (30).

8. The release control mechanism (1) according to claim 6, wherein said crank arm (60) further comprises a smoothly curved guide portion (623) disposed at the second end (62) adjacent to said notch (622) and adapted to guide said notch (622) into engagement with the pulley (34) of said rocker arm (30).

9. The release control mechanism (1) according to claim 1, wherein said torsion spring (70) has a middle part pivotally coupled to said curved middle portion (63) of said crank arm (60) by a pivot pin (64).

10. The release control mechanism (1) according to claim 9, wherein said torsion spring (70) has a first end (70*a*) stopped at a screw bolt (25) that is selectively fastened to one of a set of screw holes (24) at said substrate (20).

11. The release control mechanism (1) according to claim 9, wherein said connecting portion (621) of said crank arm (60) has a through hole (624); said torsion spring (70) has a second end (70*b*) inserted through the through hole (624) at the connecting portion (621) of the second end (62) of said crank arm (60).

12. The release control mechanism (1) according to claim 9, wherein the radial width of said torsion spring (70) is determined subject to the acting force of said release control lever (3).

13. The release control mechanism (1) according to claim 9, wherein said substrate (20) further comprises a guide portion (26) adapted to guide said releasing cable (4).

* * * * *